US010132070B2

(12) United States Patent
Madler et al.

(10) Patent No.: US 10,132,070 B2
(45) Date of Patent: Nov. 20, 2018

(54) FLEXIBLE MODULAR TRENCH

(71) Applicant: Zurn Industries, LLC, Milwaukee, WI (US)

(72) Inventors: Eric Madler, Wexford, PA (US); Collin Mangan, Chambersburg, PA (US); Jason E. Morris, Erie, PA (US)

(73) Assignee: Zurn Industries, LLC, Milwaukee, WI (US)

( * ) Notice: Subject to any disclaimer, the term of this patent is extended or adjusted under 35 U.S.C. 154(b) by 0 days.

(21) Appl. No.: 15/142,368

(22) Filed: Apr. 29, 2016

(65) Prior Publication Data

US 2017/0314251 A1 Nov. 2, 2017

(51) Int. Cl.

| | |
|---|---|
| ***E02B 13/00*** | (2006.01) |
| ***E03F 5/046*** | (2006.01) |
| ***E02D 17/08*** | (2006.01) |
| ***E01C 11/22*** | (2006.01) |
| ***E03F 3/04*** | (2006.01) |
| *E03F 5/04* | (2006.01) |

(52) U.S. Cl.

CPC ..... *E03F 5/046* (2013.01); *E01C 11/227* (2013.01); *E02B 13/00* (2013.01); *E02D 17/08* (2013.01); *E03F 3/046* (2013.01); *E03F 2005/0412* (2013.01)

(58) Field of Classification Search

CPC ... E02B 5/00; E02B 5/005; E02B 5/02; E02B 13/00; E02B 13/02; E03F 3/046

USPC ..... 405/118, 119; 404/2, 4

See application file for complete search history.

(56) References Cited

U.S. PATENT DOCUMENTS

| | | | | | |
|---|---|---|---|---|---|
| 3,212,267 | A * | 10/1965 | Biehn | E01F 5/005 | 404/2 |
| 5,066,165 | A * | 11/1991 | Wofford | E03F 3/046 | 404/4 |
| 5,252,002 | A * | 10/1993 | Day | E01F 5/005 | 405/124 |
| 5,501,547 | A * | 3/1996 | Mantelli | E01C 11/227 | 404/3 |
| 5,529,436 | A * | 6/1996 | Meyers | E01C 11/227 | 404/4 |
| 5,720,575 | A * | 2/1998 | Henrie | E02B 13/02 | 405/103 |
| 5,735,638 | A * | 4/1998 | Beamer | E03F 3/046 | 404/4 |
| 6,273,640 | B1 * | 8/2001 | Suazo | E02B 13/00 | 404/2 |
| 6,336,770 | B1 * | 1/2002 | Evans | E02B 11/005 | 138/173 |
| 6,692,186 | B1 * | 2/2004 | Suazo | E02B 13/00 | 210/170.1 |
| 6,854,925 | B2 * | 2/2005 | DiTullio | E03F 1/003 | 138/105 |

(Continued)

*Primary Examiner* — Frederick L Lagman

(74) *Attorney, Agent, or Firm* — Quarles & Brady LLP

(57) ABSTRACT

A flexible modular trench includes an open-faced channel extending along a central axis between a pair of axial ends. The open-faced channel includes a pair of axially-extending shelves connected by a trench wall. The trench wall has a smooth inner surface and a corrugated outer surface. The corrugated outer surface has corrugations extending along a plane perpendicular to the central axis to allow for increased flexibility such that the flexible modular trench is bendable in a direction perpendicular to the central axis.

14 Claims, 5 Drawing Sheets

(56) References Cited

U.S. PATENT DOCUMENTS

| | | | | |
|---|---|---|---|---|
| 6,905,285 | B2 * | 6/2005 | Little | E01C 11/227 404/2 |
| 7,156,580 | B2 * | 1/2007 | Suazo | E02B 13/00 405/118 |
| 7,165,914 | B2 * | 1/2007 | Suazo | E02B 5/02 405/118 |
| 7,306,401 | B1 * | 12/2007 | Linkogle | E02B 5/02 405/118 |
| 7,357,600 | B2 * | 4/2008 | Suazo | E02B 5/02 405/118 |
| 7,758,282 | B2 * | 7/2010 | Suazo | E02B 5/02 405/118 |
| 8,439,602 | B1 * | 5/2013 | Suazo | E02B 5/02 405/118 |
| 9,297,135 | B2 * | 3/2016 | Suazo | E02B 3/12 |
| 2009/0103982 | A1 * | 4/2009 | Hodgekins | E01C 11/227 405/118 |
| 2011/0135392 | A1 * | 6/2011 | Zajicek | E02B 5/02 405/121 |
| 2015/0136255 | A1 * | 5/2015 | Harding | F16L 11/15 137/602 |

* cited by examiner

FLEXIBLE MODULAR TRENCH

CROSS-REFERENCE TO RELATED APPLICATION

Not applicable.

STATEMENT OF FEDERALLY SPONSORED RESEARCH OR DEVELOPMENT

Not applicable.

TECHNICAL FIELD

This application relates to modular trenches used to transport liquid to a drainage sewer. More specifically, this application relates to an improved modular trench that is flexible to allow a user to install the modular trench with a slight bend.

BACKGROUND

The general concept of modular trenches is well-known in the prior art. Modular trenches are used where extensive amounts of liquid must be collected and moved from one place to another for drainage. The modular trenches typically transport the liquid to a drainage sewer. Traditionally, the modular trenches are U-shaped or V-shaped straight troughs and are installed adjacent to either roadways or buildings. They are installed in the ground and secured in place with concrete. In many cases, the modular trenches include grates to prevent large debris from falling into them and to permit people to walk over them.

In some instances, rather than installing the modular trenches adjacent to roadways or buildings, it may be necessary to install the modular trenches adjacent to a setting which requires that the modular trenches be slightly curved, such as, for example an outdoor running track, a sports field, or any other setting which may require curvature of the modular trenches. Traditionally, this results in the manufacturer providing the additional production step of bending the modular trenches before shipping them to the end customer for installation.

Currently, the process of bending the modular trenches to provide the slight curve required in some instances is time-consuming and expensive. Generally, the modular trenches are heated and then fit over a form to give the trench the desired curvature. Once the modular trenches are reshaped, they must further be shipped to the end customer while strapped onto the form so that the trenches retain their new shape and do not deform back towards their original shape.

In many instances, the settings which require the modular trenches to be slightly curved additionally do not allow for a constant radius of curvature, such as, for example, an outdoor running track, which has two elongated straight sides and two opposed curved ends. This results in several forms of varying curvature being used and further requires that the modular trenches be installed in a specific order to achieve the desired final shape. These specific installation requirements present an opportunity for the modular trenches to be installed incorrectly, which can result in the modular trenches needing to be taken out and/or reinstalled.

SUMMARY

An improved flexible modular trench is disclosed herein that provides a trench wall with a corrugated outer surface, which increases the flexibility of the flexible modular trench. This increased flexibility allows for the flexible modular trench to be bent during installation at the installation site, effectively eliminating the additional production and shipping steps described above. Moreover, because the flexible modular trenches can be bent to the desired shape or curvature during installation, the flexible modular trenches do not need to be installed in a specific order.

According to one aspect, the flexible modular trench includes an open-faced channel extending along a central axis between a pair of axial ends. The open-faced channel further includes a pair of axially-extending shelves connected by a trench wall. The trench wall has a smooth inner surface and a corrugated outer surface. The corrugated outer surface of the trench wall has corrugations that extend along a plane perpendicular to the central axis to allow for increased flexibility, further allowing for the flexible modular trench to be bendable in a direction perpendicular to the central axis.

In some instances, the smooth inner surface may have a profile perpendicular to the central axis that remains constant from a first axial end of the pair of axial ends to a second axial end of the pair of axial ends. In addition, a thickness of the trench wall between the smooth inner surface and the corrugated outer surface may fluctuate between a maximum thickness and a minimum thickness from the first axial end to the second axial end over the duration of the corrugation. The trench wall thickness may further fluctuate between the maximum thickness and the minimum thickness repetitively from the first axial end to the second axial end, resulting in rib-like corrugations.

In some cases, the pair of axially-extending shelves may include a plurality of support webs, which establish a support plane for a grate, and a lip extending away from the support plane. The lip may additionally have a corrugated outer lip surface, which may be configured to match the corrugations of the corrugated outer surface. The corrugated outer lip surface may further increase the flexibility of the flexible modular trench, especially in the regions of the shelves.

In many instances, the pair of axially-extending shelves may include multiple pairs of opposing lockdown bar slots. These pairs of opposing lockdown bar slots may be configured to receive lockdown bars which may lock a grate in place between the lips of the axially-extending shelves. The grate may further be supported on the support plane by the support webs.

In some forms, the flexible modular trench may further include a plurality of supports, which may be integrally formed with the corrugated outer surface of the trench wall. The plurality of supports may include rebar clips configured to receive supporting rebar. The plurality of supports may use the rebar clips and supporting rebar to hold the flexible modular trench in a desired shape while concrete is poured and allowed to set around the flexible modular trench.

In many instances, the smooth inner surface may be integral with the corrugated outer surface, such that the smooth inner surface and the corrugated outer surface are a single unitary component.

In some cases, the trench wall may have a smooth profile perpendicular to the central axis, which is defined by a continuous curve. Alternatively, the trench wall may have a concave profile perpendicular to the central axis, which is defined at least in part by a plurality of angled flat portions. In this case, the trench wall may have a substantially flat bottom surface. Alternatively, the trench wall may instead have a pointed bottom surface.

In some forms, the flexible modular trench may be made of a polymeric material. In these instances, the polymeric material may be at least one of high density polyethylene and polypropylene. The polymeric material may also be other polymers. The flexible modular trench drain may further include, in various forms, a foam core.

These and still other advantages of the invention will be apparent from the detailed description and drawings. What follows is merely a description of some preferred embodiments of the present invention. To assess the full scope of the invention, the claims should be looked to as these preferred embodiments are not intended to be the only embodiments within the scope of the claims.

DETAILED DESCRIPTION

Figure 1:
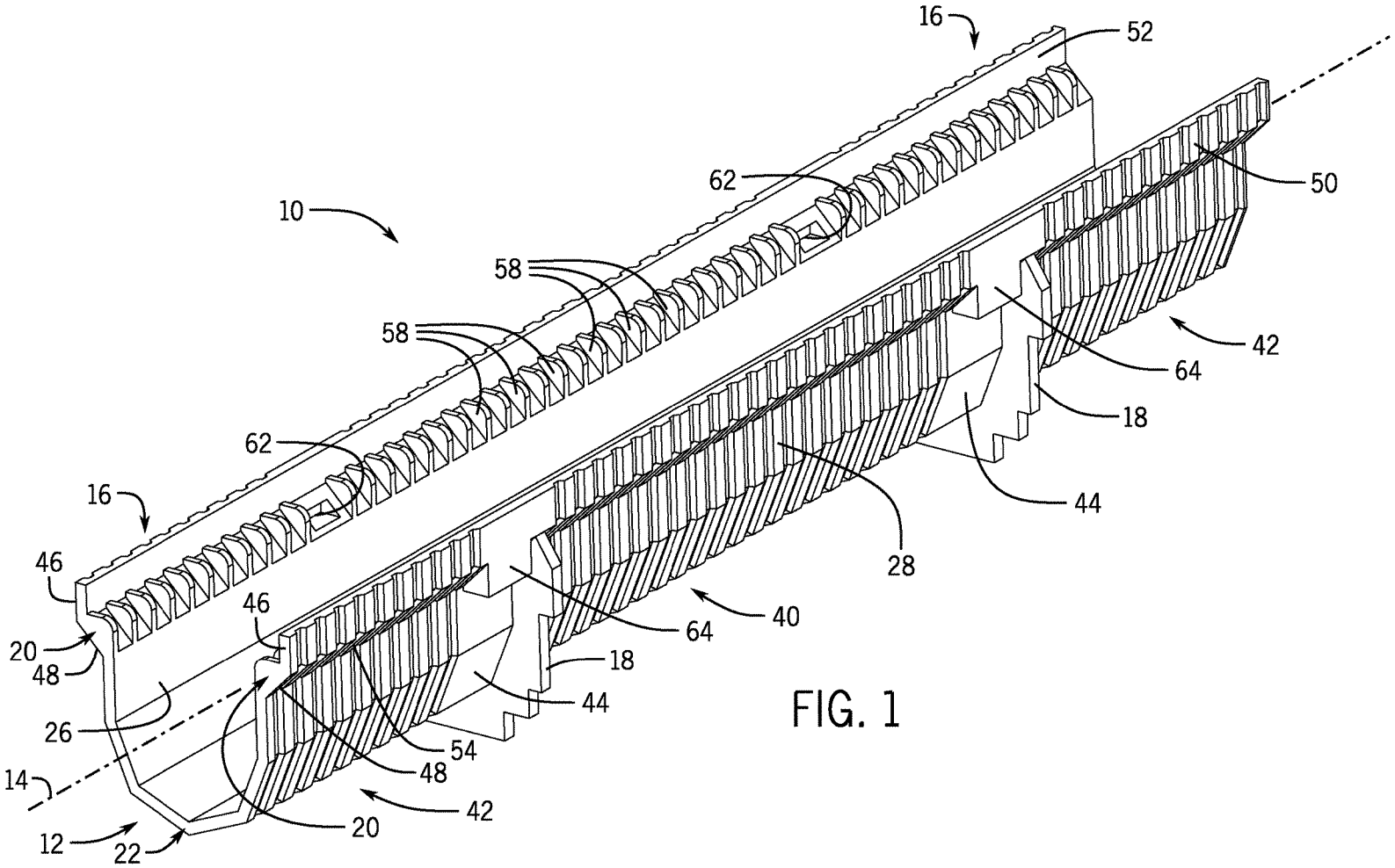
FIG. 1 is a front, top, right perspective view of a flexible modular trench.
Figure 2:
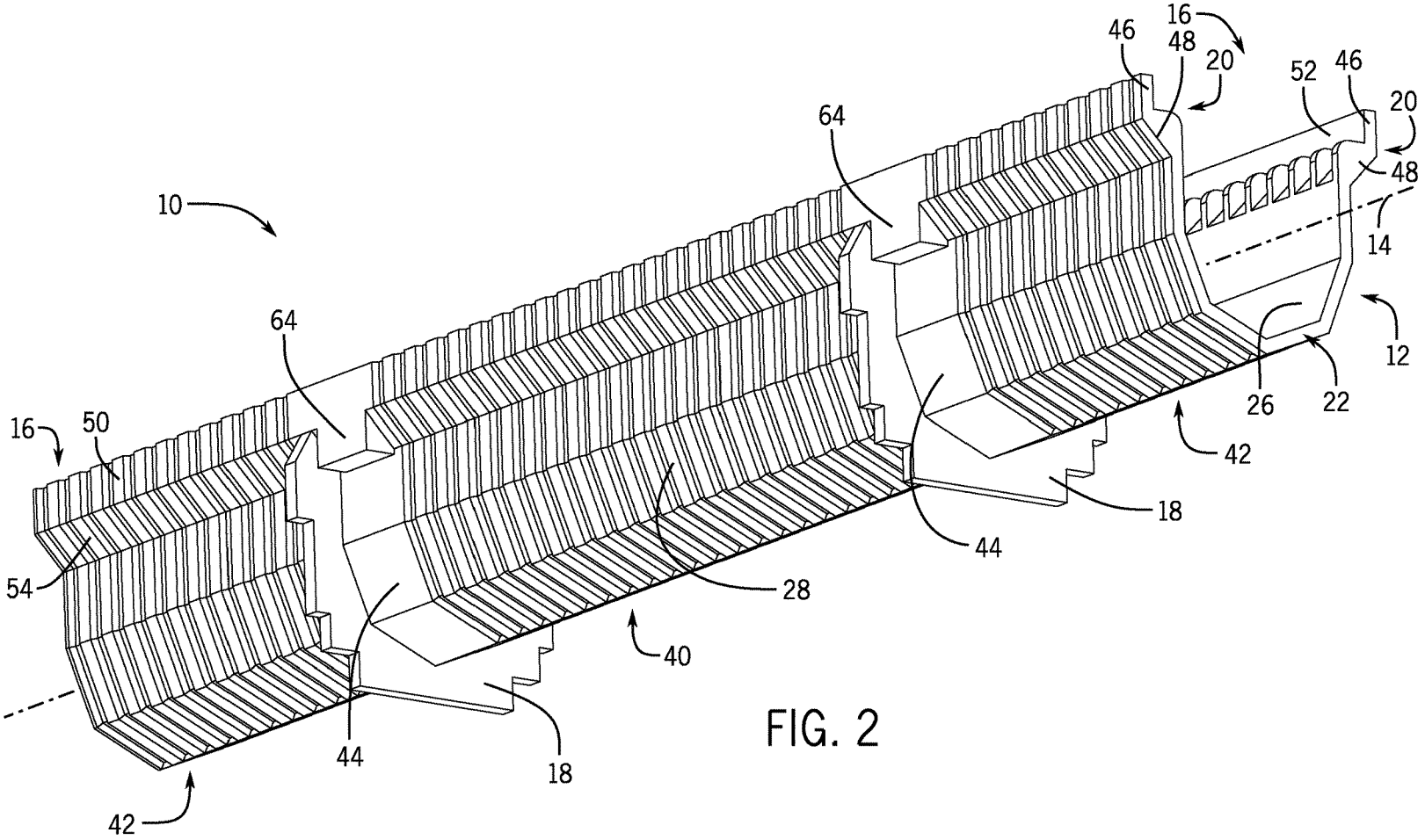
FIG. 2 is a front, bottom, left perspective view of the flexible modular trench shown in FIG. 1.

Referring to FIG. 1, a flexible modular trench 10 is illustrated. A flexible modular trench 10 of this type can be used to direct water from one place to another and may be installed in a straight or a slightly bent configuration.

Referring now more generally to FIGS. 1 through 6, the flexible modular trench 10 includes an open-faced channel. 12 extending along a central axis 14 between a pair of axial ends 16. On an underside, a plurality of supports 18 is arranged axially along the open-faced channel 12. On the pair of upper ends of the channel 12, there is a pair of axially-extending shelves 20 which are connected by a trench wall 22.

Figure 3:
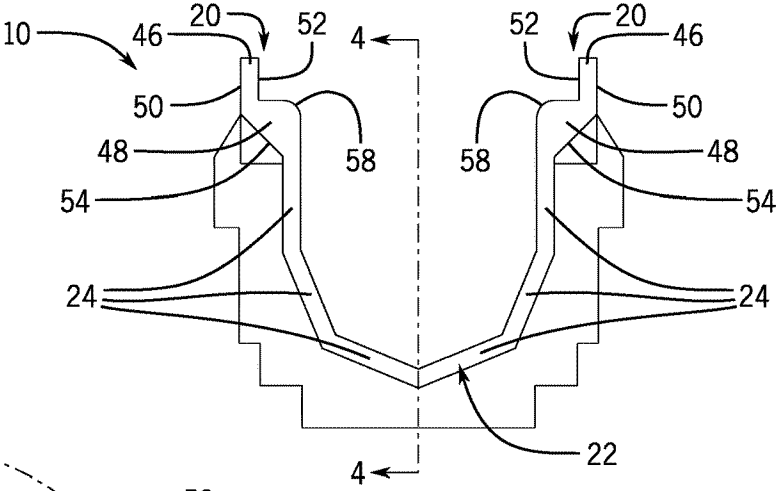
FIG. 3 is a front elevation view of the flexible modular trench shown in FIG. 1.

Referring now more specifically to FIG. 3 which looks axially down the channel 12, the trench wall 22 has a concave profile perpendicular to the central axis 14 defined at least in part by a plurality of angled flat portions 24. In the illustrated embodiment, the trench wall 22 has a pointed bottom surface. However, it is contemplated that in some other embodiments, the trench wall 22 could have a substantially flat bottom surface. Alternatively, it is further contemplated that in yet some other embodiments the trench wall 22 could have a smooth profile perpendicular to the central axis 14 defined by a continuous curve. Although various geometries might be employed, there may be some advantage to particular geometries in that they might bend or fold easier than other geometries if and when the trench 10 is bent as is described in greater detail below.

Figure 4:
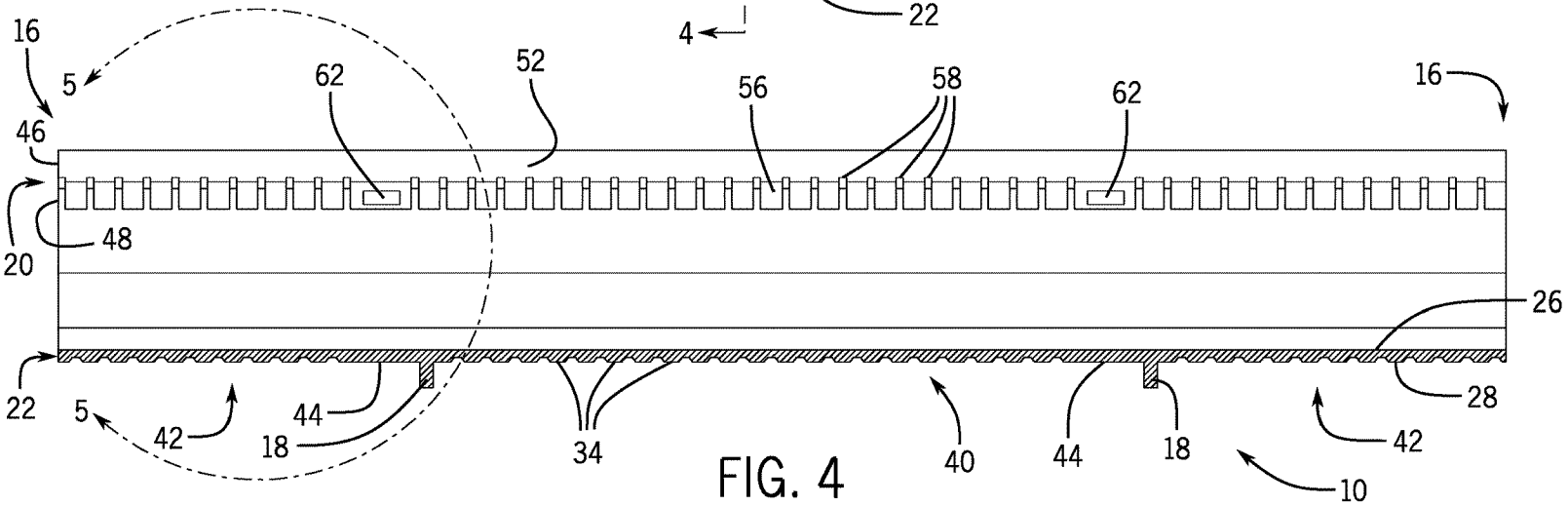
FIG. 4 is a cross-sectional view of the flexible modular trench shown in FIG. 3, taken along line 4-4.
Figure 5:
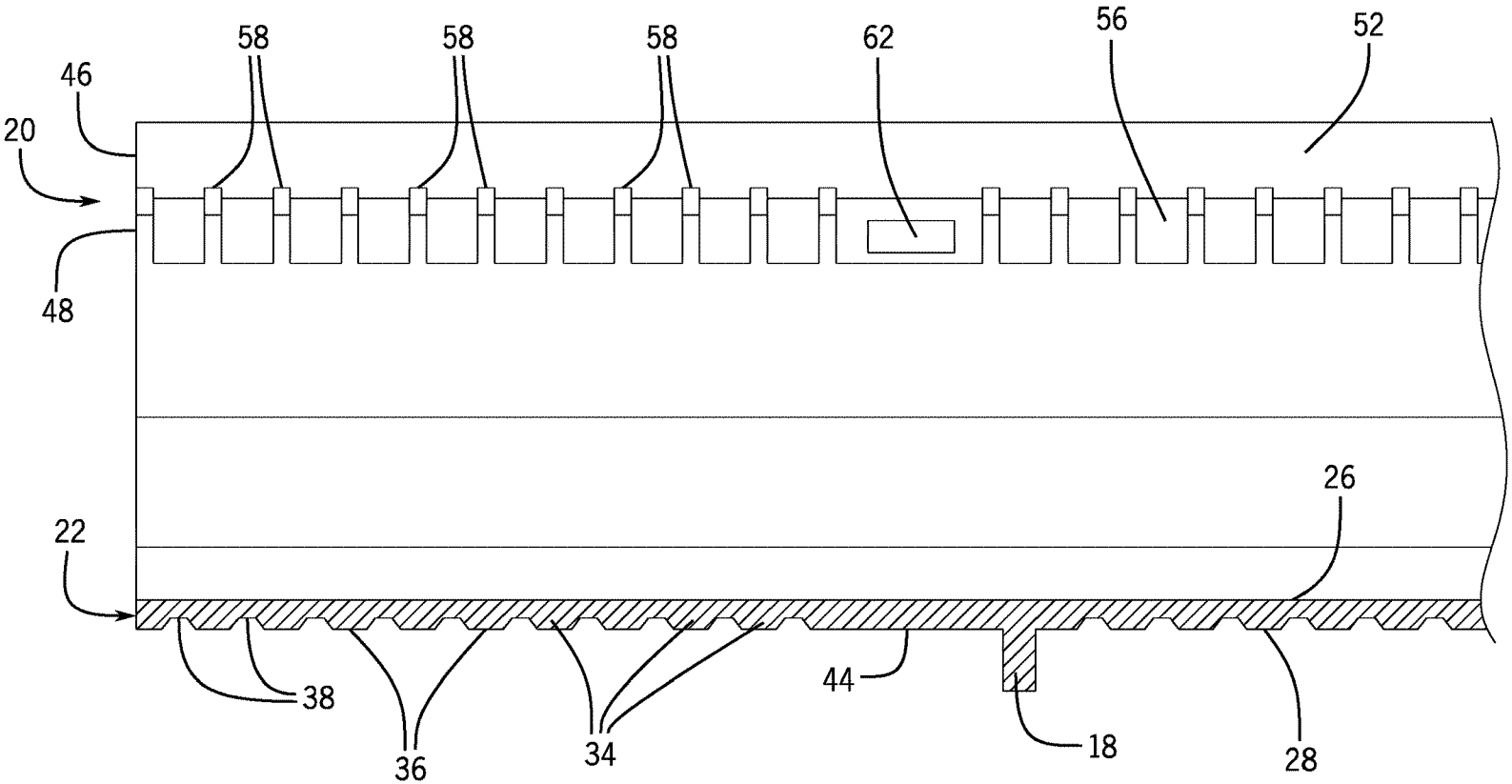
FIG. 5 is a detailed view of the flexible modular trench shown in FIG. 4, taken along line 5-5.

Now with particular reference to FIGS. 4 and 5, the trench wall 22 further includes a smooth inner surface 26 and a corrugated outer surface 28. The smooth inner surface 26 has a profile perpendicular to the central axis 14 that remains constant between the pair of axial ends 16 such that the smooth inner surface 26 is substantially flat in an axial direction. Conversely, the corrugated outer surface 28 has a plurality of corrugations 34 that extend along a plane perpendicular to the central axis 14 defining a generally U-shaped structure on the corrugated outer surface 28 of the trench wall 22 extending from one shelf 20 to an opposing shelf 20 about the central axis 14. The plurality of corrugations 34 allow for increased flexibility of the flexible modular trench 10, as will be described in detail below.

The plurality of corrugations 34 are formed by a plurality of peaks 36 and a plurality of troughs 38. The plurality of peaks 36 define a trench wall thickness between the smooth inner surface 26 and the corrugated outer surface 28 is a maximum thickness of the wall, while the plurality of troughs 38 define a minimum thickness of the wall between the smooth inner surface 26 and the troughs 38.

In the illustrated embodiment, the plurality of corrugations 34 are further grouped into a central corrugated section 40 and two outer corrugated sections 42 on the corrugated outer surface 28. The central corrugated section 40 and the two outer corrugated sections 42 are separated by a plurality of short flat sections 44, which are not corrugated, extend about the trench wall 22 parallel to the plurality of corrugations 34 and are arranged adjacent to the plurality of supports 18 as well as the later-described lockdown bar slots 62. The trench wall thickness at each of the plurality of flat sections 44 may equal to the trench wall thickness at the plurality of peaks 36. Under such conditions, this means that the flexibility of the trench 10 is derived from the fact that the thinner sections of the corrugation provide some deformability as the thicker sections are designed to provide a more rigid support structure.

The central corrugated section 40 in the illustrated embodiment includes twenty-one peaks 36 separated by twenty-two troughs 38 although such numbers are exemplary only. The two outer corrugated sections 42 are configured to additively form a corrugated section substantially identical to the central corrugated section 40. It is contemplated that the number of peaks and troughs may vary based on length and other usage considerations.

As a result of the plurality of corrugations 34, the trench wall thickness fluctuates between the maximum thickness and the minimum thickness repetitively between the pair of axial ends 16 giving the corrugated outer surface 28 a rib-like appearance.

It should further be appreciated that the smooth inner surface 26 in the illustrated embodiment is integrally formed with the corrugated outer surface 28 such that the trench wall 22, formed between the smooth inner surface 26 and the corrugated outer surface 28, is a single unitary component Said differently, the trench wall 22 is a single unitary component formed between the smooth inner surface 26 and the corrugated outer surface 28 and may be cast, molded, or otherwise formed as a single piece without the need for assembly. Such integral qualities do not preclude the possibility that the material forming the overall body be foam-cored at its center.

Referring again to FIGS. 1 though 6 generally, the pair of axially-extending shelves 20 are disposed along opposing top edges of the trench wall 22 and each include a lip 46 offset from the trench wall 22 by a shelf wall 48, which is angled away from the central axis 14 and extends between the trench wall 22 and the lip 46. The lip 46 extends vertically from the shelf wall 48 and further includes a corrugated outer lip surface 50 and a smooth inner lip surface 52. The shelf wall 48 includes a corrugated outer shelf surface 54 and an inner shelf surface 56 having a plurality of inner shelf support webs 58 extending therefrom. The plurality of inner shelf support webs 58 collectively establish a support plane, which extends horizontally between the plurality of inner shelf support webs 58 of each of the pair of axially-extending shelves 20.

The corrugated outer lip surface 50 and the corrugated outer shelf surface 54 include corrugations formed by peaks and troughs similar to and configured to align with the plurality of corrugations 34 of the corrugated outer surface 28 of the trench wall 22 further increasing the flexibility of the flexible modular trench 10 (especially in the region of the shelves 20), as will be described in detail below.

The pair of axially-extending shelves 20 further include multiple pairs of opposing lockdown bar slots 62 recessed horizontally into the inner shelf surfaces 56, through the shelf walls 48, and into corresponding lockdown bar Protrusions 64 protruding horizontally from the corrugated outer shelf surface 54. The multiple pairs of opposing lockdown bar slots 62 are configured to receive lockdown bars (not shown). The lockdown bars may be configured to lock a grate (not shown) between the lips 46 of the pair of axially-extending shelves 20. The grate may further be supported by the inner shelf surface 58 on the support plane and may be used to prevent large debris from falling into the flexible modular trench 10 when the flexible modular trench 10 is installed and provide a walking surface for people.

It should be appreciated that the plurality of flat sections 44 of the corrugated outer surface 28 are a result of the corresponding lockdown bar protrusions 64 described above and are included solely for increased ease of manufacturing. It is contemplated that in some other embodiments the corrugated outer surface 28 may not include the plurality of flat sections 44.

As described above, the plurality of flat sections 44 of the corrugated outer surface 28 are arranged adjacent to the plurality of supports 18. The plurality of supports 18 are integrally formed with the corrugated outer surface 28 of the trench wall 22, such that the corrugated outer surface 28 and the plurality of supports 18 form a single unitary component. It is contemplated that, in some other embodiments, the corrugated outer surface 28 may be formed separately from the plurality of supports 18 and then coupled to the plurality of supports 18 using adhesive, fasteners, or other suitable coupling methods.

In some instances, the plurality of supports 18 may further include rebar clips (not shown) configured to receive supporting rebar. The plurality of supports 18 and the rebar clips may be used in conjunction with the supporting rebar to hold the flexible modular trench 10 in a desired shape and position while concrete is poured and allowed to set around the flexible modular trench 10, as will be described in detail below.

With the structure of the flexible modular trench 10 having been described above, the production and installation of the flexible modular trench 10 will now be described in detail below.

The flexible modular trench 10 can be made of a polymeric material, such as, for example, high density polyethylene, polypropylene, or any other suitable polymer. It is also contemplated that the flexible modular trench 10 could also be formed by a multitude of other materials. Additionally, the flexible modular trench 10 can include a foam core (not shown), which can allow the flexible modular trench 10 to retain structural rigidity while reducing both weight and material cost. The flexible modular trench 10 can further be formed by any of casting, injection molding, compression molding, or any other suitable forming operation.

Figure 6:
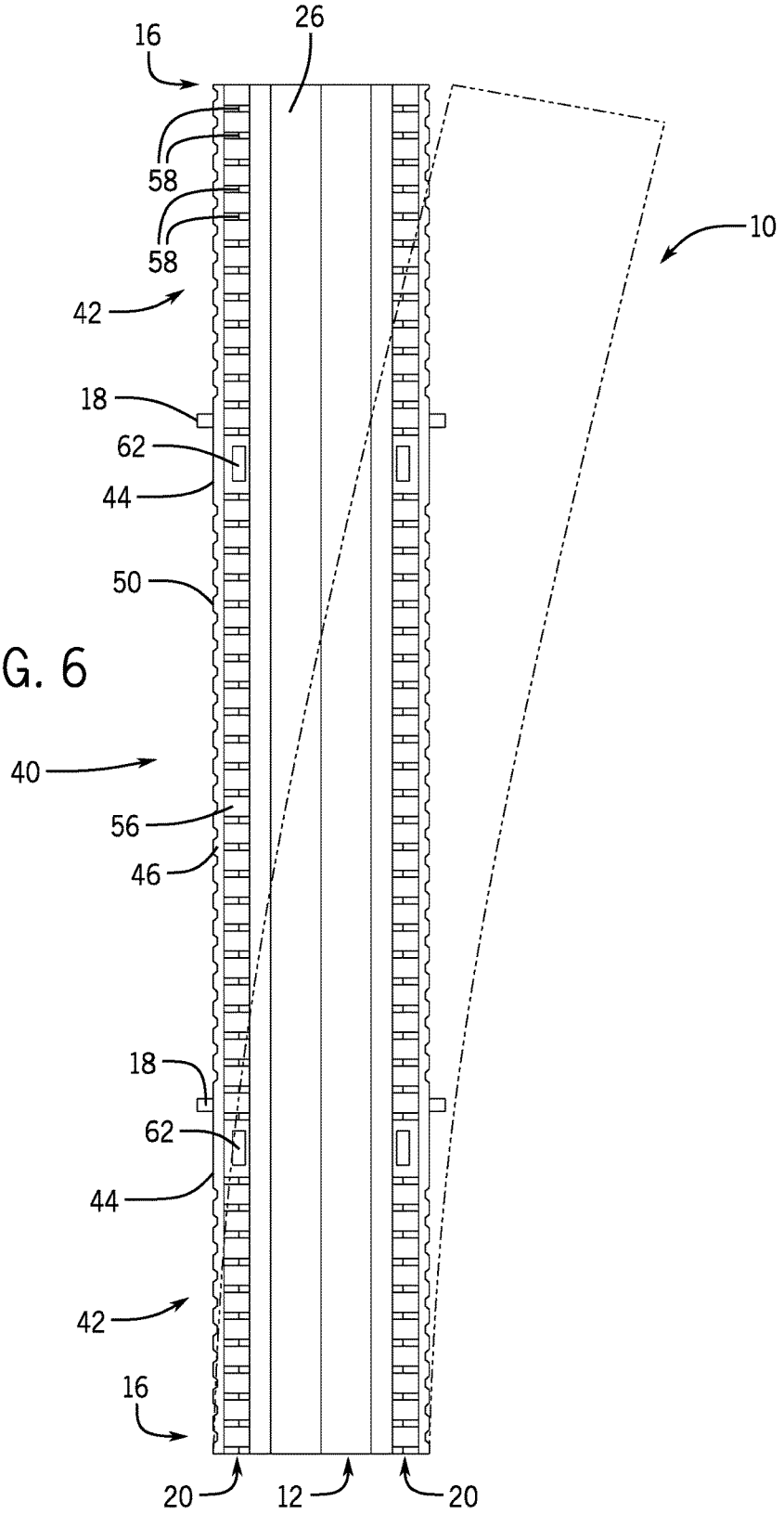
FIG. 6 is a top plan view of the flexible modular trench of FIG. 1, further showing the flexible modular trench in a bent configuration illustrated by dashed lines.

During installation, the flexible modular trench 10 may be installed in either a substantially straight configuration (shown in solid lines in FIG. 6) or in a slightly bent configuration (shown in dashed lines in FIG. 6). In either case, the flexible modular trench 10 is placed into a ditch, which may be dug into the ground or may be formed by a pre-existing concrete recess, and then has concrete poured around it, such that the concrete fills a void between the ditch and the flexible modular trench 10. The concrete is then allowed to set, and once the concrete is set, the flexible modular trench 10 is installed.

In the case that the flexible modular trench 10 is to be installed with a slight bend, the flexible modular trench 10 is first placed into the ditch, as described above. Then, a first support of the plurality of supports 18 is locked in place within the ditch. This may be done by installing supporting rebar into the ditch and coupling the first support to the supporting rebar. As mentioned above, this may be done through rebar clips, attached to the first support, coupling the first support to the supporting rebar. It is also contemplated that the first support could be locked or held in place using other methods.

Once the first support is locked or held in place, the flexible modular trench 10 is slightly bent into the desired configuration and held in place by a person installing the flexible modular trench 10. When the flexible modular trench 10 is bent, the plurality of troughs 38 of the corrugated outer surface 28, as well as the corresponding troughs of the corrugated outer shelf surface 54 and the corrugated outer lip surface 50, provide increased flexibility by locally reducing the cross-sectional area of the trench wall 22 and deform. This local reduction in cross-sectional area allows for one axially-extending side of the flexible modular trench 10 closest to the center of curvature of the bend to slightly compress while an opposite axially-extending side slightly stretches, all while applying less force than compared to a modular trench without the above-described plurality of troughs and corrugation.

Conversely, when the flexible modular trench 10 is bent, the plurality of peaks 36 of the corrugated outer surface 28, as well as the corresponding peaks of the corrugated outer shelf surface 54 and the corrugated outer lip surface 50, provides structural rigidity by locally increasing the cross-sectional area of the trench wall 22. This local increase in cross-sectional area prevents the flexible modular trench 10 from buckling while being bent.

Once the flexible modular trench 10 is bent into the desired configuration, a second support of the plurality of supports 18 is locked in place within the ditch similarly to the first support.

The process described above is repeated until all of the plurality of supports 18 are locked in place within the ditch. Then, as described above, concrete is poured into the ditch, around the flexible modular trench 10, filling the void between the ditch and the flexible modular trench 10. Similarly, once the concrete is set, the flexible modular trench 10 is installed.

It should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A flexible modular trench comprising:

an open-faced channel extending along a central axis between a pair of axial ends and including a pair of axially-extending shelves connected by a trench wall, the trench wall having a smooth inner surface and a corrugated outer surface; and wherein the corrugated outer surface has corrugations extending along a plane perpendicular to the central axis to allow for increased flexibility such that the flexible modular trench is bendable in a direction perpendicular to the central axis and each of the pair of axially-extending shelves include a plurality of support webs, which establish a support plane, and a lip extending away from the support plane.

2. The flexible modular trench of claim 1, wherein the smooth inner surface has a profile perpendicular to the central axis that remains constant from a first axial end of the pair of axial ends to a second axial end of the pair of axial ends.

3. The flexible modular trench of claim 1, wherein a trench wall thickness between the smooth inner surface and the corrugated outer surface fluctuates between a maximum thickness and a minimum thickness from a first axial end of the pair of axial ends to a second axial end of the pair of axial ends.

4. The flexible modular trench of claim 3, wherein the trench wall thickness fluctuates between the maximum thickness and the minimum thickness repetitively from the first axial end to the second axial end.

5. The flexible modular trench of claim 1, wherein the lip on each of the pair of axially-extending shelves has a corrugated outer lip surface.

6. The flexible modular trench of claim 1 wherein the pair of axially-extending shelves includes multiple pairs of opposing lockdown bar slots.

7. The flexible modular trench of claim 1, further including a plurality of supports integrally formed with the corrugated outer surface of the trench wall.

8. The flexible modular trench of claim 1, wherein the smooth inner surface is integral with the corrugated outer surface, such that the smooth inner surface and the corrugated outer surface are a single unitary component.

9. The flexible modular trench of claim 1, wherein the trench wall has a smooth profile perpendicular to the central axis defined by a continuous curve.

10. The flexible modular trench of claim 1, wherein the trench wall has a concave profile perpendicular to the central axis defined at least in part by a plurality of angled flat portions.

11. The flexible modular trench of claim 1, wherein the trench wall has a substantially flat bottom surface.

12. The flexible modular trench of claim 1, wherein the trench wall has a pointed bottom surface.

13. The flexible modular trench of claim 1, wherein the flexible modular trench is made of a polymeric material.

14. The flexible modular trench of claim 13, wherein the polymeric material is at least one of high density polyethylene and polypropylene.

* * * * *